US007661450B2

(12) United States Patent
Wang

(10) Patent No.: US 7,661,450 B2
(45) Date of Patent: Feb. 16, 2010

(54) PROCESS FOR MAKING A BAMBOO FILAMENT SLAB FLOOR BY OPPOSITE DIRECTIONAL HOT PRESSING

(76) Inventor: Zhengfeng Wang, B-201, Office Building, World Trade Center, No. 122 Shuguang Road, Hangzhou (CN) 310007

( * ) Notice: Subject to any disclaimer, the term of this patent is extended or adjusted under 35 U.S.C. 154(b) by 434 days.

(21) Appl. No.: 11/622,453

(22) Filed: Jan. 11, 2007

(65) Prior Publication Data

US 2008/0053570 A1 Mar. 6, 2008

(30) Foreign Application Priority Data

Sep. 1, 2006 (CN) ..... 2006 1 0053253

(51) Int. Cl.
*B27J 7/00* (2006.01)

(52) U.S. Cl. ..... 144/333; 144/344; 144/380

(58) Field of Classification Search ..... 144/329, 144/333, 344–346, 348, 350, 352, 366, 369, 144/380
See application file for complete search history.

(56) References Cited

U.S. PATENT DOCUMENTS 5,343,913 A * 9/1994 Tanahashi et al. ..... 144/380
5,976,644 A * 11/1999 Sanaee et al. ..... 428/17
6,098,680 A * 8/2000 Nien ..... 144/380
7,021,346 B2 * 4/2006 Chang ..... 144/333

* cited by examiner

*Primary Examiner*—Shelley Self
(74) *Attorney, Agent, or Firm*—Global IP Services; Tianhua Gu

(57) ABSTRACT

The present invention relates to bamboo manufacturing field, in particular, to a process for making a bamboo filament slab floor by opposite directional hot pressing. Aiming to overcome the defects that, while compressing, the existing bamboo filament slab floor at normal temperature under cold pressing is easy to rebound and expand, has low strength and weak resistance to abrasion and is easy to mildew while using for a long time, the present invention adopts shredding bamboo sheet, sizing treatment, molding bamboo filament and etc. procedures, characterized in that, a secondary drying procedure should be inserted between said sizing treatment and bamboo filament molding procedure; said sizing treatment should be implemented by soak sizing bamboo filament; said compressing includes opposite directional hot pressing of positive pressing and side pressing. The present invention adopts specific manufacturing technology, thus the floor can avoid the occurrence of holes and gaps inside bamboo filament slab floor and discharge formaldehyde and has stable quality, and will be not prone to mildew and deform while using for a long time. It can be widely used and suitable for indoor and outdoor flooring and various boards used in decoration and furniture.

12 Claims, 3 Drawing Sheets

PROCESS FOR MAKING A BAMBOO FILAMENT SLAB FLOOR BY OPPOSITE DIRECTIONAL HOT PRESSING

CROSS REFERENCE TO THE RELATED PATENT APPLICATION

This application claims the priority right of the Chinese patent application No. 200610053253.0, filed on Sep. 1, 2006.

FIELD OF THE INVENTION

The present invention relates to bamboo manufacturing field, in particular, to a process for making a bamboo filament slab floor by opposite directional hot pressing.

BACKGROUND OF THE INVENTION

With the development of economy, wooden floor has been widely used, which results in the global forest resources having been damaged more execrably. In order to preserve the ecological environment and meet people's living requirements at the same time, bamboo floor is becoming the best substitute of wooden floor. Since bamboo forests grow fast and have the advantages of strong regenerative ability and short growth cycle and people are introducing and expanding bamboo consciously, the area of global bamboo forest has been increasing year-by-year, while on the contrary, the global forest area is decreasing year-by-year. And meanwhile, bamboo timber is hard, has a strong tensile strength and compression resistance, and it is a kind of pure, natural, green, raw material, so it can avoid the harm on human being that should be caused by plastic floor with chemical substances. Therefore, it is quite believable to realize the practice of "replacing wood by bamboo".

The total area of bamboo forest in China is 5000 thousand hectare, occupying ¼-⅕ of total area of bamboo forest around the world. With the rich raw materials of bamboo resources and long bamboo timber processing and applying experience, applying bamboo timer in floor making has become an inevitable tendency.

Traditionally bamboo block slab floor is a kind of artificial floor made by bamboo timber, formed by varnishing, polishing and notching bamboo block slab floor. The preparation process of slab floor is to machining bamboo into big bamboo block with rectangular cross section, then to pave bamboo block horizontally with several layers overlapped veneering or with several blocks longitudinally veneering, and to form slab floor with long strip structure. The slab floor with strip structure mentioned above can get the needed rectangle cross section only from thicker moso bamboo, which shows high demand for selecting materials; top and lop of bamboo and bamboo root cannot be used, which causes heavy waste and low raw materials availability; organic matter in bamboo block is not fully removed, which will cause the occurrence of mildewing or rotting and shorten the service life of floor; due to different sources of bamboo timbers, different growth environments and different growth ages of bamboo, the quality between bamboo blocks should be quite different, which will result in flexible deformation, insufficient hardness of floor made and weak resistance to abrasion.

As for the existing technology, first bamboo timber is drawn into filament and then the filament is veneered and compressed into slab to make bamboo floor. Though the strength of said bamboo floor is higher than the traditional horizontally or vertically pressed bamboo block floor, the solidification at normal temperature is not complete, thus condensate is reduced, cracked or expanded or deformed at a certain temperature and product quality is not stable, therefore, deformation of tile-shaped or warpage and collapse in both edges are easy to take place. While compressing at normal temperature, formaldehyde in glue cannot be fully released. In the bamboo floor made by drawing bamboo into filament and then veneering the filament and compressing into slab for the existing technology, there is still a certain content of formaldehyde in the glue, which cannot meet the lowest standard of formaldehyde content. Meanwhile, due to the limitation of fixed size of mould, the slab size is fixed, thus the species and sizes of finished product at final-period processing are limited, therefore, the product cannot be used widely and the manufacturing cost is high as well.

SUMMARY OF THE INVENTION

The present invention aims to solve the technical problem and to provide technical task to overcome the defects in the existing process for making bamboo slab floor, to provide a process for making a bamboo filament slab floor by opposite directional hot pressing. The bamboo slab floor compressed and made by adopting specific secondary drying, soak sizing and opposite directional hot pressing, etc. procedures is not easy to rebound and expand and has the advantages of high density, high strength, stronger wear resistance, and it is not prone to mildew and deform while using for a long time. Furthermore, the technical task for present invention is to make bamboo slab floor with lower formaldehyde content, more product species and sizes and wider fields of application.

In order to realize the aims mentioned above, the present invention adopts the following technical solution: a process for making a bamboo filament slab floor by opposite directional hot pressing, including the sequential procedures of selecting materials, splitting and sawing, removing the outer and inner surface layers, shredding bamboo sheet, anti-corrosion treatment, primary drying, sizing treatment, molding bamboo filament, compressing, balancing, is characterized in that, a secondary drying procedure shall be inserted between said sizing treatment and bamboo filament molding procedure; said sizing treatment should be implemented by soak sizing bamboo filament, wherein said glue content is 15%~20%; said compressing should be opposite directional hot pressing, including positive pressing on upper and lower opposite faces and side pressing on left and right opposite faces, and then cooling in holdup pressure state and pressure relief procedure at last; said positive pressure should be 50~100 MPa, side pressure should be 10~50 MPa, hot-press temperature should be 130~150° C. and hot-press time should be 15~60 minutes. The bamboo filament is soaked in glue pool for a period of time in order to fully combine glue and bamboo filament; secondary drying aims to remove the excessive water in bamboo filament after soak sizing to guarantee fine glue effect of bamboo filament, thus product quality is improved; with the high temperature and pressure and increased solidification effect of glue, the hot-press veneering between bamboo filaments will segregate and discharge formaldehyde, etc. substances in glue which is harmful to human body; multidirectional pressurizing makes slab compact and solid and avoids the occurrence of holes and gaps by uneven pressurizing; meanwhile, a compressed slab has high density, in particular, side pressing on left and right faces fully consolidates the edges of slab and prevents said parts from brittle cracking and edge collapsing; after finishing hot-press solidification, by using cooling system to keep on holdup pressure cooling, slab is cooled rapidly, and then pressure relief is implemented; thus the slab compressed and made by this method features has be finer quality, more stable structure and will not deform again.

Said opposite directional hot pressing procedure for the present invention is implemented by pressurizing bamboo filament paved in the molding boards, wherein in inner cavity of the molding boards, steam and cooling water pipe is installed, said molding boards include the upper, lower, left and right four side boards around bamboo filament and the four side boards can be moved horizontally in opposite directions while exerting a pressure. In addition to implementing up and down vertical pressurizing according to the existing compressing manufacturing technology, the present invention pressurizes horizontally on side faces, at least pressurizes on four side faces simultaneously in order to make slab compact and solid and void the occurrence of holes and gaps along the directions that bamboo filament paved, the slab has more stable quality; steam and cooling water pipes positioned inside molding boards is easy to heat and cool. During pressurizing stage, molding boards move in opposite directions to compress bamboo filament and during pressure relief stage, they move in reverse direction to the direction mentioned above. Moreover, under sufficient positive and side pressure and by adjusting the thickness and width sizes of molding boards, bamboo slab floor with needed shapes and specifications suitable for subsequent products can be prefabricated, which increases the applicability of products. For instance, the cross section of bamboo slab floor shapes trapezoid or rectangle according to the figure of molding boards. The slab with trapezoid cross section has wedge inclines along the edges, which is convenient for splicing slabs and is suitable for various different demands of use.

Said molding bamboo filament for the present invention includes paving bamboo filament in a crisscross pattern or paving bamboo filament longitudinally with plural layers into molding boards; said molding boards should be plural layers. The slab made by compressing bamboo filament paved in a crisscross pattern has more stable structure, internal stress of flexural deformation caused by bamboo filaments inside it during absorbing moisture while using should be counteracted and arching deformation is not prone to take place; by putting overlapped plural board layers, more slabs can be made once, thus production efficiency will be increased.

Said anti-corrosion treatment for the present invention should be directly stewing or wet carbonizing bamboo filament in order to fully remove organic matter contained in bamboo filament such as sugar, protein, etc. and to avoid the occurrence of mildewing and rotting. The natural color and carbonizing color of bamboo filaments made by the two different technologies features are respective, suitable for various manufacturing demands of different colors, or special striation slab should be made by using striated colors formed by adulterating the two kinds of bamboo filaments. Said wet carbonization should be carbonizing natural bamboo filament with natural moisture directly, thus uneven carbonizing color or interlace and ragged edge caused by carbonizing after pre-drying natural bamboo filament can be avoided.

The water content for said primary drying for the present invention is 6~8% and the water content for secondary drying is 8~12%. Wherein the water content for said primary drying is suitable for implementing subsequent sizing; the water content for secondary drying is suitable for implementing subsequent compressing, if too dry, the surface of slab is easy to interlace and the adhesive capacity between bamboo filaments should be weak; if too wet, the surface of slab is easy to appear dark or light "color deviation", thus the quality should be influenced.

Said shredding bamboo sheet as bamboo filaments procedure for the present invention should be implemented by rolling press or cleaving by a cutter. The processing is quite convenient and easy to realize.

Bamboo filament is applied as the raw material for the present invention. By adopting specific quite fully soak sizing, secondary drying and opposite directional hot pressing at high temperature under high pressure as an assistant means, not only the solidification effect of glue is enhanced, but also the harmful substances to human body such as formaldehyde, etc. are discharged while implementing hot pressing and sizing by using high temperature, and meanwhile, by multidirectional pressurizing on over four sides, slab is made compact and solid and avoids the occurrence of holes and gaps due to uneven pressurizing, thus the slab has more stable quality and will be not prone to mildew and deform while using for a long time. The bamboo filament slab floor made can be widely used and suitable for indoor and outdoor flooring and various boards used in decoration and furniture.

In all figures: 1. mould; 2. bamboo filament; 3. molding board.

DETAILED DESCRIPTION OF THE INVENTION

Figure 1:
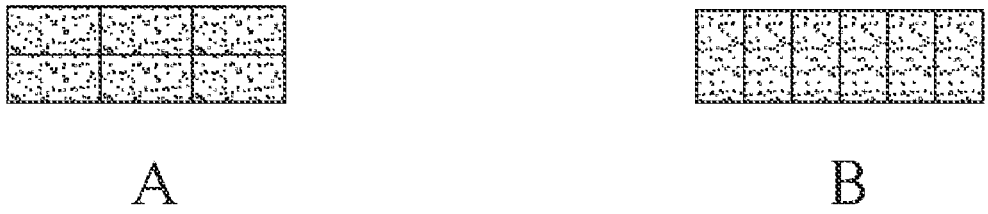
FIG. 1: a structural schematic diagram for the existing two kinds of bamboo block floors.

To combine the drawings and the embodiments, the further description for the present invention will be exhibited hereinafter:

FIG. 1 exhibits the structure of existing ordinary bamboo block slab floor, wherein A displays strip structure overlapped and veneered with several layers by bamboo block of rectangle cross section paved horizontally, and B displays strip structure veneered by bamboo block of rectangle cross section paved longitudinally. The bamboo block floor made according to aforesaid process has high demand for selecting materials; the availability of bamboo timber is low and waste is high; organic matter in bamboo block is not fully removed, which will cause the occurrence of mildewing or rotting and shorten the service life; the differences between bamboo blocks will result in flexible deformation, insufficient hardness and weak resistance to abrasion.

Figure 2:
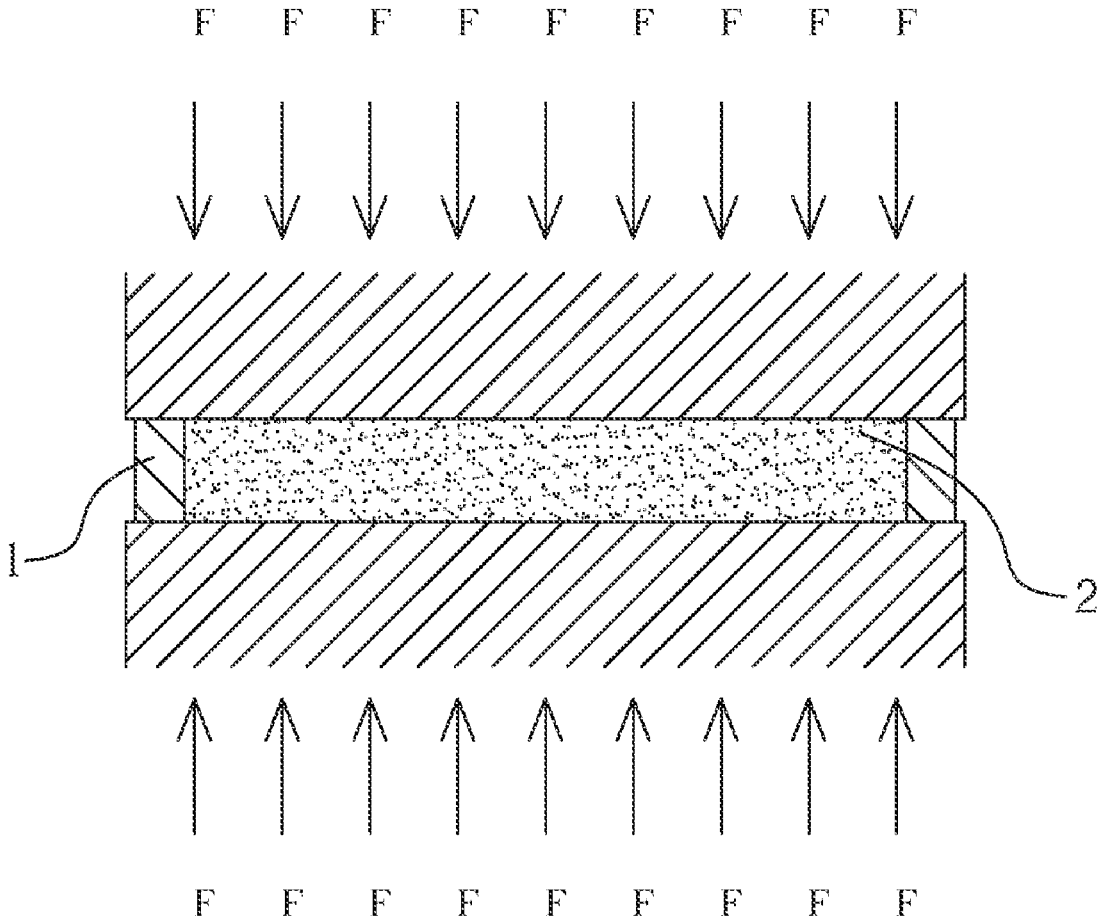
FIG. 2: the principle schematic diagram for compressing the existing bamboo filament slab floor.

FIG. 2 exhibits the compressing process to make the existing bamboo filament slab floor, namely, at normal temperature under cold pressing without heating, vertically pressurizing bamboo filament 2 in upper and lower two directions while compressing, wherein there is no pressure around bamboo filament, mould 1 fixed only by depending on the side faces itself is used as boundary to limit the moving of bamboo filament 2 and to help to shape, holes and gaps are easy to occur inside bamboo filament floor made by aforesaid process; the slab made by compressing at normal temperature has instable quality, while pressure come from outside is removed, rebound and expansion are easy to take place again, thus the quality of floor should be influenced.

Figure 3:
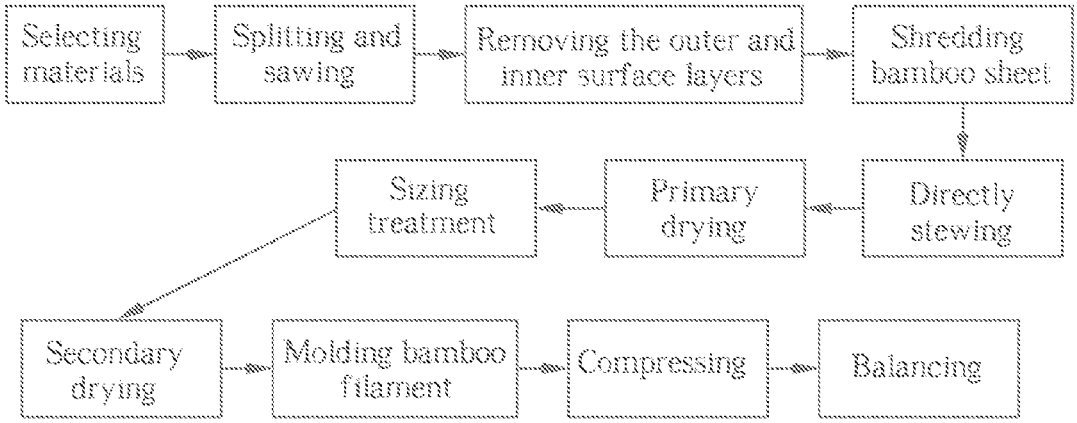
FIG. 3: a block diagram of production process of embodiment 1 for the present invention.
Figure 4:
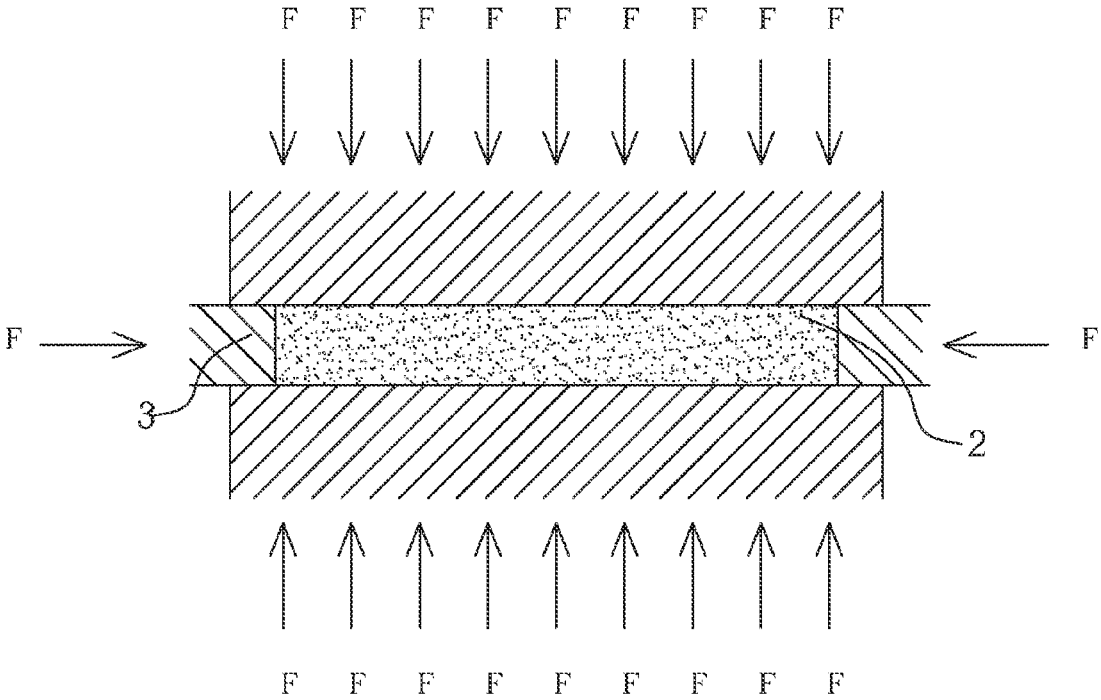
FIG. 4: the principle schematic diagram for opposite directional hot pressing.

The embodiment 1 for the present invention as shown in FIG. 3 is a process for making a bamboo filament floor by opposite directional hot pressing, wherein the procedures are as follows:

a. selecting materials, there is no special demand for the thickness of bamboo timber, the top and lop and root of bamboo can also be fully used;

b. splitting and sawing, according to the needed length of bamboo fiber, the selected moso bamboo is rolling pressed and hacked into bamboo sheet with suitable length;

c. removing the outer and inner surface layers, i.e., removing the outer and inner surface layers of bamboo sheet;

d. shredding bamboo sheet as bamboo filaments, by rolling press or cleaving by a cutter, bamboo sheet is shredded into bamboo filament;

e. directly stewing (i.e. anti-corrosion treatment), by removing organic matter contained in bamboo filament such as sugar, protein, etc. to avoid the occurrence of mildewing and even rotting, the bamboo filament made is bamboo filament with natural color.

f. primary drying, water content is limited to 7%;

g. sizing treatment, bamboo filaments are bound in heaps and then fully soaked into glue pool by water-resistant glue, wherein the major components include phenol glue, epoxy glue, melamine, isocyanate and caustic soda, glue content is limited to 15%, bamboo filaments are soaked for 30 minutes and then fished out and drained until fully dry;

h. secondary drying, sized bamboo filament is dried and water content is limited to 10%;

i. molding bamboo filament, bamboo filament is paved in a crisscross pattern with several layers into the molding boards, the upper and lower and side faces of which can horizontally move, to wait for pressurizing treatment, if only the quality of the added bamboo filament compressed each time is the same as the space formed by the moving of molding boards, the consistency of the density and specification of slab can be insured;

j. compressing, said compressing is opposite directional hot pressing, including positive pressing on upper and lower opposite faces and side pressing on left and right opposite faces, wherein said positive pressure on upper and lower opposite faces should be 50 MPa, side pressure should be 20 MPa, the temperature should be 130° C. and hot-press time should be 30 minutes. After finishing hot pressing, holdup pressure is kept the same, after cooling for 5 minutes, pressure relief should then be implemented;

k. balancing, formed bamboo filament slab is stored in dry natural environment indoors for five to ten days or more. The purpose is to remove remaining stress, and to make water content even distributing in the filament slab FIG. 4 exhibits the principle of opposite directional hot pressing for the present invention. Bamboo filament 2 is paved in moulding board 3 positioned in the upper, lower, left and right four sideboards around bamboo filament. In inner cavity of said moulding boards, steam and cooling water pipes are installed (not shown in figure). By machine drive while compressing, upper and lower vertical moulding boards and left and right horizontal moulding boards all move inwards. Bamboo filament 2 is compressed, then heating and cooling can be realized by depending on steam and cooling water pipes in inner cavity of said moulding boards, and the moulding boards should be withdrawn and repositioned after finishing compressing.

Figure 5:
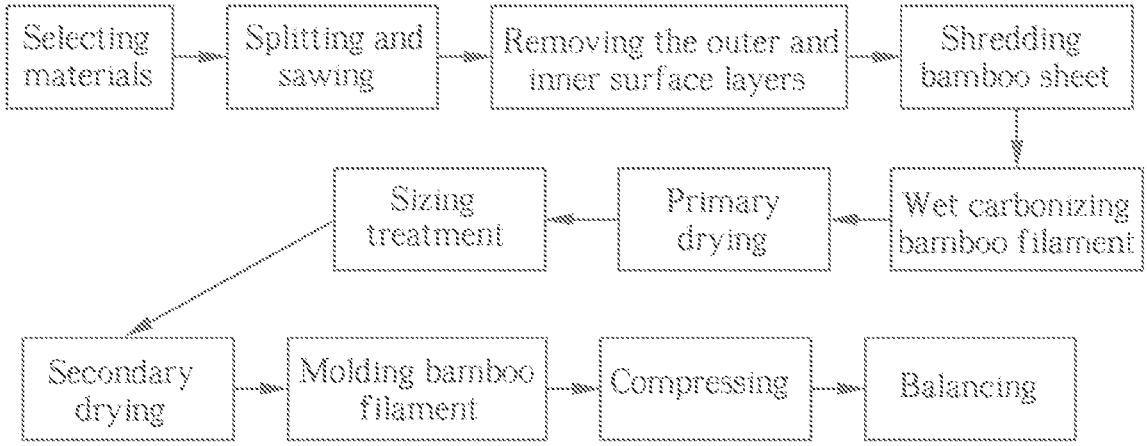
FIG. 5: a block diagram of production process of embodiment 2 for the present invention.

The embodiment 2 for the present invention as shown in FIG. 5 is different with embodiment 1. The difference is that anti-corrosion treatment should be wet carbonizing treatment, namely, natural bamboo filament with natural moisture is carbonized directly to make bamboo filament have carbonizing color. The bamboo filament slab made at last should be carbonizing color. The rest parts are all the same as embodiment 1.

What is claimed is:

1. A process for making a bamboo filament slab floor by opposite directional hot pressing, including following sequential procedures:

splitting and sawing bamboo as bamboo sheets, removing the outer and inner surface layers of the bamboo sheet;

shredding the bamboo sheets as bamboo filaments;

anti-corrosion treatment for the bamboo filaments by directly stewing or wet carbonizing;

primary drying for the bamboo filaments;

sizing treatment for the bamboo filaments, fully soak the bamboo filaments into glue pool by water-resistant glue, the glue content is 15%~20%;

secondary drying the bamboo filaments;

molding bamboo filaments, pave the bamboo filaments in a crisscross pattern with several layers into molding boards having upper and lower and side faces which can horizontally move;

compressing treatment for the bamboo filaments, first, opposite directional hot pressing, including positive pressing on upper and lower opposite faces and side pressing on left and right opposite side faces, followed by cooling under pressure state and pressure relief procedure at last; said positive pressure is 50~100 MPa, said side pressure is 10~50 MPa, a temperature of said hot-press is 130~150° C. and a period of said hot-press 15~60 minutes;

balancing treatment for formed bamboo filament slab floors, which are stored in a dry natural environment indoors for five to ten days or more to remove remaining stress, and to make water content even distributing in the filament slab floors.

2. The process for making a bamboo filament slab floor by opposite directional hot pressing according to claim 1, wherein said opposite directional hot pressing procedure is implemented by pressurizing the bamboo filament paved in a cavity defined by the molding boards, steam and cooling water pipes are installed in the molding boards, said molding boards include an upper, a lower, a left, right, front and rear side boards, and the four side boards can be moved horizontally in opposite directions by exerting a pressure.

3. The process for making a bamboo filament slab floor by opposite directional hot pressing according to claim 2, wherein the bamboo filaments are paved in a crisscross pattern in said molding boards, said molding boards are plural layers for more slabs can be made once.

4. The process for making a bamboo filament slab floor by opposite directional hot pressing according to claim 2, wherein the bamboo filaments are paved longitudinally with plural layers in said molding boards; said molding boards are plural layers for more slabs can be made once.

5. The process for making a bamboo filament slab floor by opposite directional hot pressing according to claim 1, wherein the anti-corrosion treatment is stewing bamboo filament directly to remove organic matters contained in the bamboo filament to avoid occurrence of mildewing and even rotting, the bamboo filament is with natural color.

6. The process for making a bamboo filament slab floor by opposite directional hot pressing according to claim 2, wherein anti-corrosion treatment is stewing bamboo filament directly to remove organic matters contained in the bamboo filament to avoid occurrence of mildewing and even rotting, the bamboo filament is with natural color.

7. The process for making a bamboo filament slab floor by opposite directional hot pressing according to claim 1, wherein the anti-corrosion treatment is wet carbonizing bamboo filament to carbonize natural bamboo filament with natural moisture directly.

8. The process for making a bamboo filament slab floor by opposite directional hot pressing according to claim 2, wherein the anti-corrosion treatment is wet carbonizing bamboo filament to carbonize natural bamboo filament with natural moisture directly.

9. The process for making a bamboo filament slab floor by opposite directional hot pressing according to claim 1, wherein a water content for said primary drying is 6~8% and a water content for said secondary drying is 8~12%.

10. The process for making a bamboo filament slab floor by opposite directional hot pressing according to claim 2, wherein a water content for said primary drying is 6~8% and a water content for said secondary drying is 8~12%.

11. The process for making a bamboo filament slab floor by opposite directional hot pressing according to claim 1, wherein shredding the bamboo sheet as the bamboo filaments procedure is implemented by rolling splitting press or cleaving by a cutter.

12. The process for making a bamboo filament slab floor by opposite directional hot pressing according to claim 2, wherein shredding the bamboo sheet as the bamboo filaments procedure is implemented by rolling splitting press or cleaving by a cutter.

* * * * *